US007021847B2

(12) United States Patent
Lunn

(10) Patent No.: US 7,021,847 B2
(45) Date of Patent: Apr. 4, 2006

(54) MARKING DEVICE

(75) Inventor: Alan John Lunn, Sheffield (GB)

(73) Assignee: Edward Pryor & Son Limited, Sheffield (GB)

( * ) Notice: Subject to any disclaimer, the term of this patent is extended or adjusted under 35 U.S.C. 154(b) by 63 days.

(21) Appl. No.: 09/764,926

(22) Filed: Jan. 18, 2001

(65) Prior Publication Data

US 2002/0090242 A1 Jul. 11, 2002

(30) Foreign Application Priority Data

Jan. 9, 2001 (GB) ..... 0100495

(51) Int. Cl.
*B41J 2/22* (2006.01)

(52) U.S. Cl. ..... 400/124.01

(58) Field of Classification Search ..... 400/124.01, 400/124.11, 127, 129, 131; 101/3.1, 4
See application file for complete search history.

(56) References Cited

U.S. PATENT DOCUMENTS 4,197,550 A * 4/1980 Held ..... 346/29
4,557,191 A * 12/1985 Speicher ..... 400/128
4,808,018 A * 2/1989 Robertson et al. ..... 400/127
5,240,141 A * 8/1993 Blette ..... 222/95
5,785,436 A * 7/1998 Harrison et al. ..... 400/127
6,135,022 A 10/2000 Troester ..... 101/18
6,188,148 B1 * 2/2001 Curreno ..... 310/12
6,263,980 B1 * 7/2001 Wadge ..... 173/217

FOREIGN PATENT DOCUMENTS

EP 0 687 577 7/1988

* cited by examiner

*Primary Examiner*—Anthony H. Nguyen
(74) *Attorney, Agent, or Firm*—Fish & Richardson P.C.

(57) ABSTRACT

A marking device (10) comprises a housing (12) having a handle (16). A frame (20) is pivotally mounted in the housing aout a first axis (22). A marking head (40) mounted on the frame for translational movement in the frame by a first motor (84) in a first direction (x) parallel said first axis and spaced therefrom. A second motor (100) is arranged to pivot the frame with respect to the housing about said first axis in a second, substantially orthogonal direction (y). The pin moves in a third orthogonal direction (z). The motors (84, 100) are disposed within the confines of the frame (20) and move on fixed screws (84, 104).

77 Claims, 4 Drawing Sheets

MARKING DEVICE

FIELD OF THE INVENTION

This invention relates to a marking device, particularly for metal surfaces by impacted dot formation for permanent identification purposes.

BACKGROUND

In the automotive and aerospace industries (especially), it is more and more frequently desired to mark permanently different components of a vehicle in the course of its manufacture. Moreover, it is desired to mark pieces after assembly in the vehicle to ensure each is marked with the relevant markings for the vehicle in question. Thus, rather than marking individual components in a fixed marking machine, the desire now is to mark the components in situ with a portable, handheld marking device.

On the other hand, with the advent of machine readable codes, precise marking is of significant importance. There is a need therefore to combine the conflicting requirements of lightness and compactness of a handheld marking device with the precision and robustness that impact marking needs in order to be reliably machine readable.

U.S. Pat. No. 6,135,022 addresses some of these issues but nevertheless fails to provide a design of device which is either easy to construct or has great precision. U.S. Pat. No. 6,135,022 discloses a marking device having a base frame to which is pivoted a head drive frame in which a translational carriage is slidingly disposed. A manifold is mounted on the carriage and carries a marking device. The head drive frame is pivoted by a motor driven cam plate. Another motor drives a belt for translational movement of the carriage. The whole arrangement is disposed in a casing provided with a handle.

Despite being intended for handheld operation, the design is heavy, bulky and may lack precision.

SUMMARY OF THE INVENTION

Accordingly, it is an object of the present invention to overcome the problems identified above, or at least to mitigate their effects.

In accordance with the present invention there is provided a marking device comprising:

a housing of the device;

a frame pivotally mounted in the housing about a first axis;

a marking head mounted on the frame for translational movement in the frame by a first motor in a first direction parallel said first axis and spaced therefrom; and a second motor arranged to pivot the frame with respect to the housing about said first axis in a second, substantially orthogonal direction.

By providing such an arrangement, the dual components of U.S. Pat. No. 6,135,022 of the base frame and the casing are integrated in the same housing of the device so that the base frame of the above-identified patent is essentially dispensed with.

A handle may be provided for manipulating the device, and indeed, this is the primary application for the device. Nevertheless, the present device has applications other than in handheld arrangements. The compact, and hence relatively light, device is suited for connection to the end of robotic arms, for example, or even for installation in static marking machines.

Preferably, said housing is a clamshell housing opening in said first direction, said frame having a pivot pin captured in a bearing bush in each clamshell.

The clamshells may be moulded from plastics material, in which event there will inevitably exist some tolerance in the dimensions of the clamshell when mated together. Accordingly, a disc spring is preferably disposed on at least one pin between the housing and the frame to take up any tolerance between the housing and frame. The disc spring is compressed when the clam shells are first assembled and holds the frame in a specific position. This is done without greatly increasing the frictional engagement between the frame and the housing, at least not to such an extent that the frame is clamped by the housing. There is thus no need for the dimensional tolerances of the housing to be exact. Indeed, the extra friction caused by the disc spring has the advantage of providing some damping of the pivoting of the frame in the housing. Preferably, a disc spring is disposed on each pin.

Preferably, a window is provided in the housing through which the marking head protrudes. The window may be detachable from the housing, so that it may be exchanged for differently shaped windows adapted for engagement with differently shaped surfaces to be marked. The detachability of the housing also exposes the marking head, thereby facilitating exchange of the stylus of the marking head.

For example, the window may comprise a V-section across said first direction and be adjustable on the housing in a third direction substantially orthogonal said first and second directions. Said adjustment permits the distance from the marking head to the surface of the object being marked to be adjusted depending on the shape and dimensions of the object being marked. V-section windows are especially suitable for marking cylindrical surfaces.

An alternative window may comprise a key element adapted to fit a corresponding locating element either permanently or temporarily fixed on a surface to be marked. The marking effected by the device is therefore precisely located with respect to the locating on the object being marked.

Preferably, the window has a facing of resilient material adapted to abut the surface to be marked and reduce the tendency for the device to "walk" during actuation of the marking head.

Said marking head preferably has a stylus pin arranged to be driven in said third direction against a surface to be marked.

Said pin is preferably driven by a solenoid coil in a head housing and comprises a ferromagnetic piston slideable in a cylindrical chamber to impact a base of said pin. A return spring preferably returns the pin and piston to a ready position.

Said frame preferably comprises a rail and a carriage slideable along said rail in said first direction. In this event, said head housing may be mounted substantially directly on said carriage and is about the same dimensions as said carriage so that recoil and return impacts of said piston are transmitted directly into said carriage and thence to the rail and frame. Bolting the head housing directly onto the carriage and a rail practically imposes a substantial rail on the marking device. That is to say, commercially available carriages and rails are such that a carriage large enough to have the head housing of the marking head mounted directly on the carriage necessarily imposes a robust and massive rail. However, it is precisely here that mass and bulk are desirable in order to absorb impact vibration caused by the marking head, as well as providing a heat sink for the solenoid, and as well as the inertial reaction mass for the accelerating solenoid piston.

In a second, different aspect, the present invention provides a marking device comprising:

a housing of the device;

a frame arranged for pivotal movement with respect to the housing about a first axis;

a marking head mounted on the frame for translational movement in the frame by a first motor in a first direction parallel said first axis and spaced therefrom; and a second motor arranged to pivot the frame with respect to the housing about said axis in a second, substantially orthogonal, direction; wherein said marking head includes a stylus pin adapted to be driven in a third direction substantially orthogonal said first and second directions against a surface to be marked, the device having a centre of gravity substantially coincident said third direction over substantially all movements of the frame in said second direction.

This arrangement ensures that recoils and rebounds of the marking device do not cause moments of inertia about the centre of gravity thereby reducing the tendency of the device to creep or walk across a works surface.

In a third aspect, the invention provides a marking device comprising:

a housing of the device;

a frame arranged for pivotal movement with respect to the housing about a first axis;

a marking head mounted on the frame for translational movement in the frame by a first motor in a first direction parallel said first axis and spaced therefrom;

a second motor arranged to pivot the frame with respect to the housing about said axis in a second, substantially orthogonal, direction; and said motors being disposed substantially within the confines of the frame.

By disposing the motors within the confines of the frame, they do not project beyond the frame and, accordingly, a compact arrangement ensues. Moreover, the requirements of the second aspect of the present invention are also facilitated by this arrangement.

In both the second and third aspects, a handle may be provided for manipulating the device, and, like in the first aspect of the present invention, this is the primary application for the device.

Preferably, each motor comprises a body, and a rotary armature threaded on a fixed screw. By fixing the screw, and moving the motor up and down the screw, there is no movement of the screw along its longitudinal axis, and therefore no need to provide the space for such movement.

Preferably the first and second, first and third, or ideally first second and third aspects of this invention are combined, to a greater or lesser extent, in the same device. That is also to say, of course, that in the second and third aspects, when not employing the first aspect, the frame will be pivoted in an element separate from, but fixed in, the housing.

In this event, the first motor is preferably carried on the carriage, the fixed screw being fixed in the frame. The frame may comprise a U-shaped element along the base of which is fixed a rail and between the arms of which is fixed the screw. Said pivot pins are also preferably disposed in said arms.

Preferably, the solenoid carriage, rail and the rotational axis of said first motor, are all in line. The motor therefore adds to the inertial mass of the rail.

Preferably, a sub-frame is pivotally mounted in the frame about a sub-axis parallel said first axis, the second motor being fixed in said sub-frame, and the fixed screw of the second motor being fixed in a clevis pivoted in the housing about a clevis axis also parallel said first axis.

Said clevis may comprise pivot pins captured in a bearing bush in each clamshell in the region thereof forming said handle of the device. Again, with the motor moving with the frame, the clevis need only comprise sufficient structure to provide pivot pins and a secure mounting for the fixed screw of the second motor. On the other hand, the sub-frame, to which the motor is fixed can serve as the heat sink for the motor which thus does not need a special element for that purpose.

Preferably, said first axis is between a marking point of said marking head and the point of application of said second motor to the frame. The distance between the marking point and said first axis is preferably greater than the distance between said first axis and said point of application. This has two effects, the first is to minimise the chordal travel of the marking head as it moves in the second direction. This reduces character distortion, as well as any tendency of the device to "walk " during successive impacts. On the other hand, it requires higher precision of the second motor, which commercially available stepper motors are now able to accommodate. However, the primary reason for the "scissor" action in the second direction is to facilitate the compact arrangement of the handheld device. Preferably, the solenoid, carriage, rail, rotational axis of said first motor and the pivot axis of the sub-frame in the frame, are all in line. This further increases the entire inertial mass of the device behind the solenoid piston thereby minimising recoil effects, particularly, moments. It is only with the scissor arrangement that the in line arrangement of the massive components of the marking device can all be arranged in line.

Preferably, said point of application comprises said sub-axis.

Said handle may comprise a pistol grip and include a trigger to actuate the marking device.

Preferably, the marking device comprises a separate console controlling actuation of the motors to move the marking head in a desired pattern and to fire the marking head, a control lead from said console entering the base of said pistol-grip handle.

Preferably, said lead terminates on a distribution board disposed in said pistol grip handle, said board preferably being substantially free of electronic components.

BRIEF DESCRIPTION OF THE DRAWINGS

The invention is further described hereinafter, by way of example, with reference to the accompanying drawings, in which.

DETAILED DESCRITPION

Figure 1:
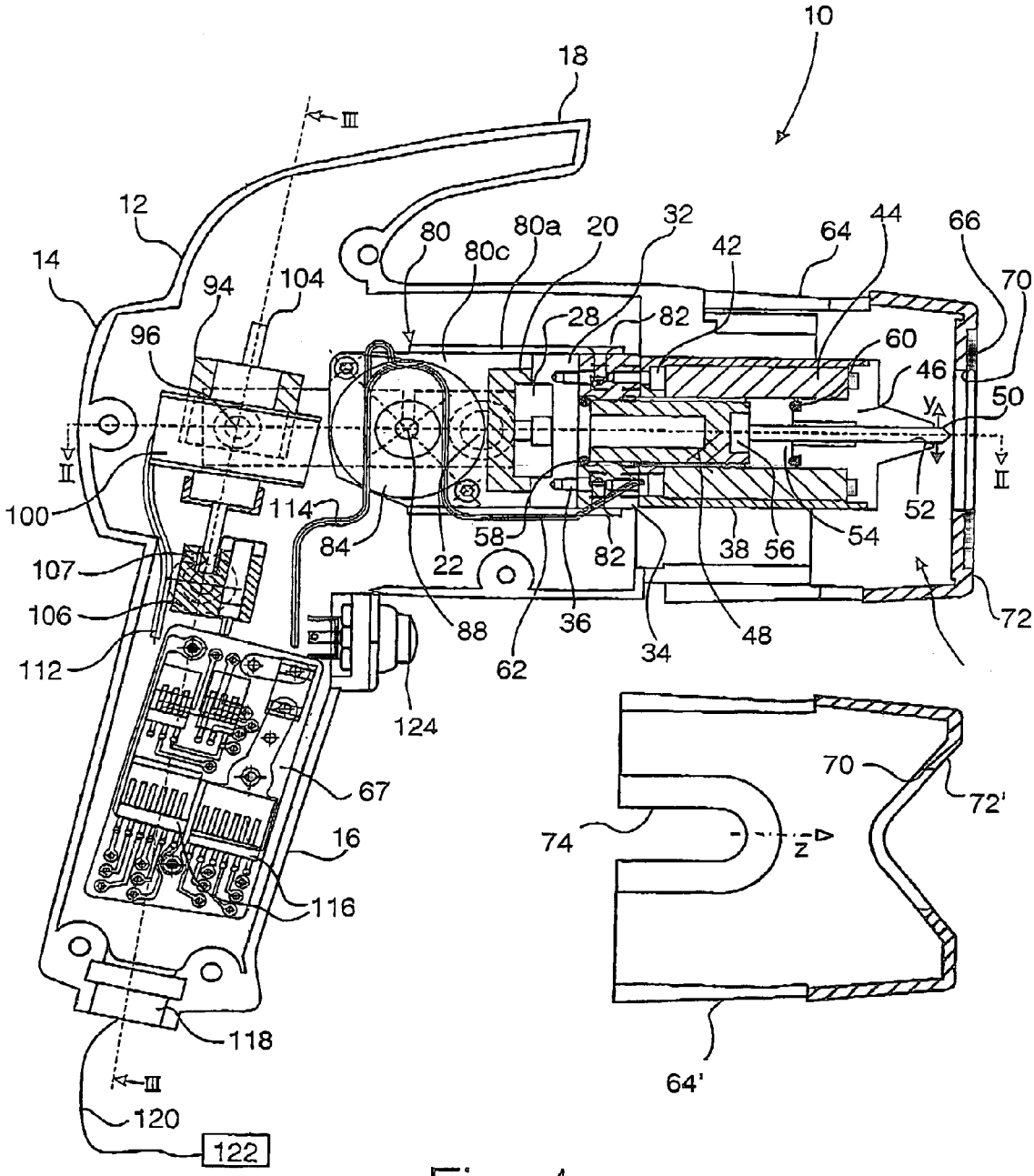
FIG. 1 is a side section through a marking device in accordance with the present invention.

Referring to the drawings, a marking device 10 comprises a plastics housing 12 comprising two clamshell halves 12*a,b* joined at a centre line 12*c* extending around the entire periphery of the device 10. The clamshell halves are connected together by screws (not shown) and define a main body 14, a pistol grip handle 16 and a top steady handle 18.

In the body 14 is pivotally disposed a frame 20 comprising two pivot pins 22 received in bushings 24 fitted into the housing 12. To permit variation in the dimensional precision of the clamshell housing 12 when mated together, a disc spring 26 is disposed between each pivot pin 22 and its corresponding bearing bush 24. The disc spring 26 serves to centralise the frame 20 within the housing body 14 and take up any loose play between them.

Figure 4:
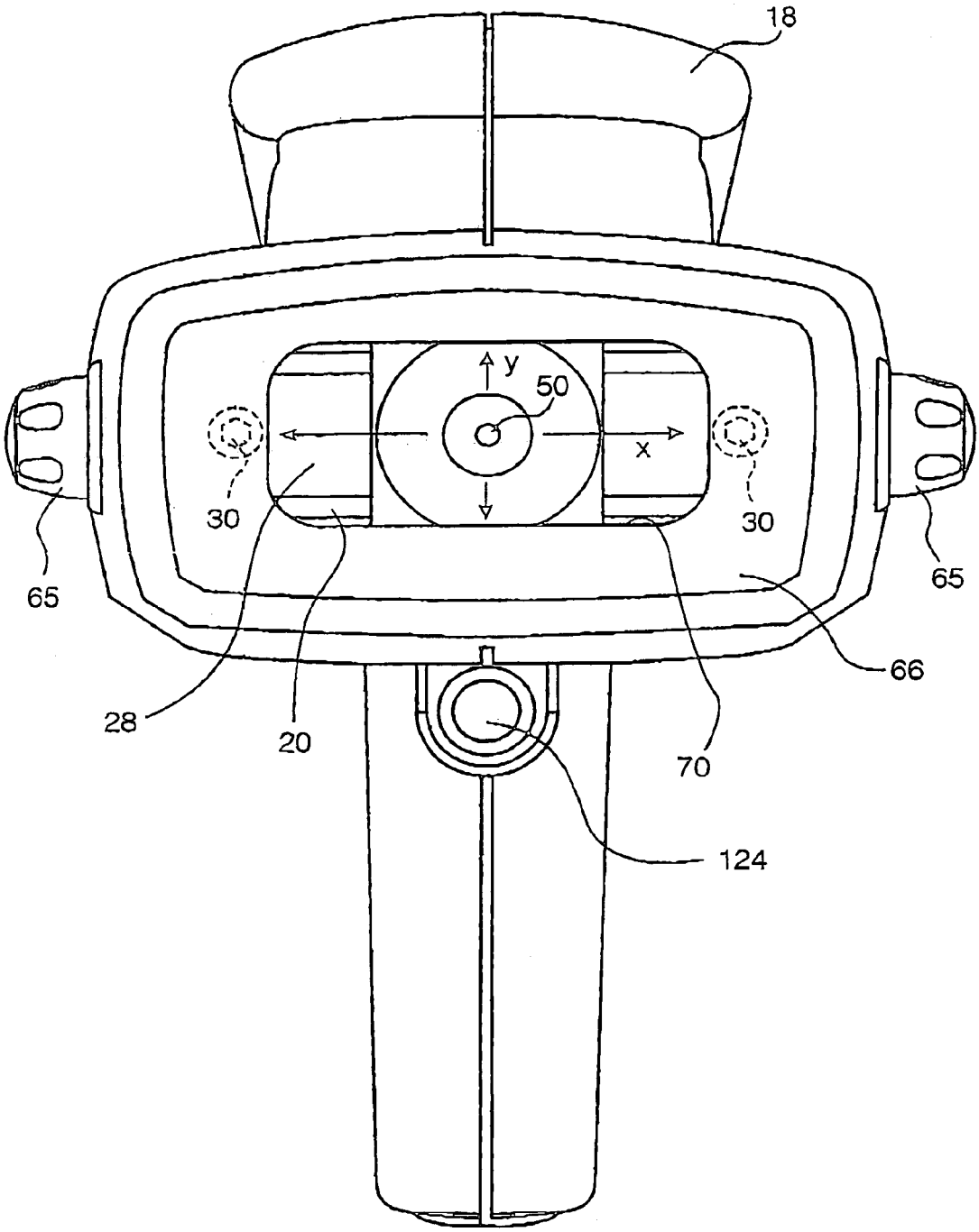
FIG. 4 is a view in the direction of arrow IV in FIG. 1.

The frame 20 is essentially U-shaped, along the base 21 of which is fixed a rail 28 by machine screws 30 (see FIG. 4). Slideably carried in a first, x, direction on the rail 28 is a carriage 32 to which is fixed the hollow base 34 of a solenoid marking head 40. The base 34 is fixed to the carriage 32 by screws 36. A solenoid can 38 is secured to the base 34 by screws 42 and carries a solenoid 44. The solenoid is captivated by an end cap 46 screw threaded into the end of the can 38.

Figure 2:
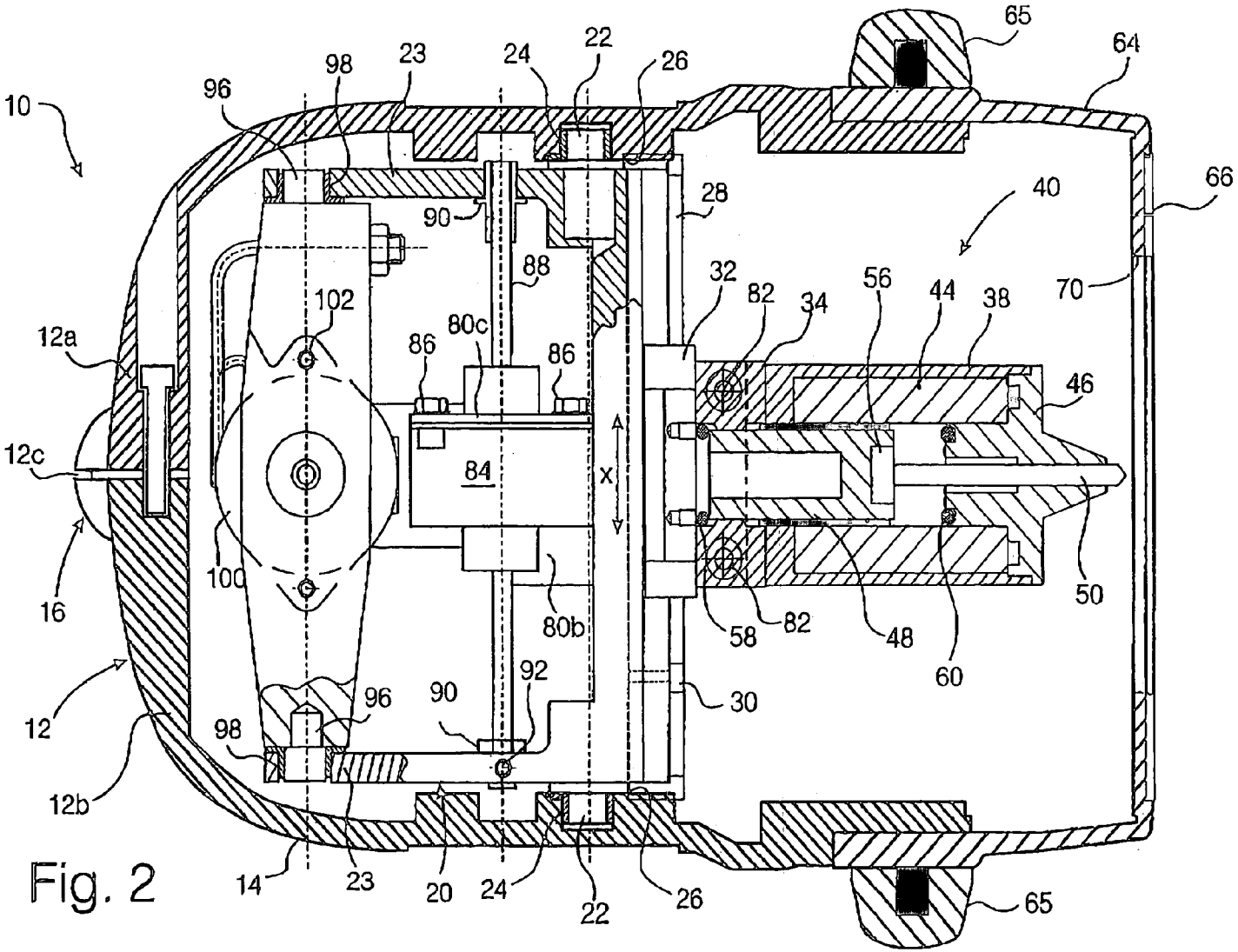
FIG. 2 is a section on the line II—II in FIG. 1.
Figure 3:
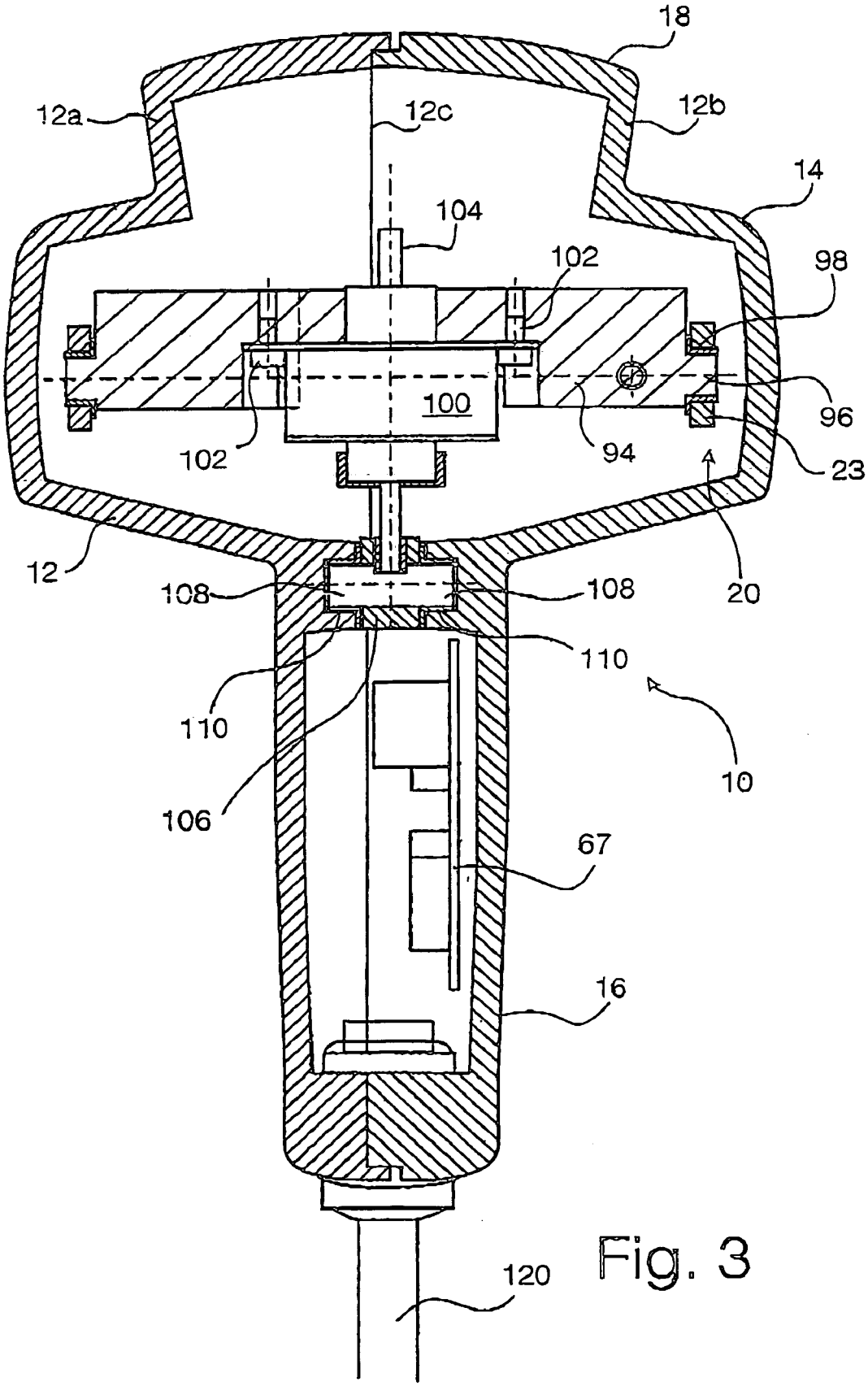
FIG. 3 is a section on the line III—III in FIG. 1.

A piston 48 of ferromagnetic material is slidingly received in a bore 49 formed by the base 34, can 38 and solenoid 44. The piston at one end acts on a stylus pin 50, which is slideably received in a bore 52 of the cap 46. A spring 54 presses a head 56 of the pin 50 into engagement with the piston 48, and also presses the piston 48 towards a ready position thereof against the carriage 32, a rubber O-ring 58 serving as a cushion for the piston 28 during a rebound after firing. Likewise, the cap 46 is provided with an O-ring 60 (shown only in FIG. 2) to cushion the impact of the piston 48 when the marking head is fired (at least, instead of the point of the pin 50 striking a workpiece when that is within range). A lead 62 from a distribution board 67 received in the handle 16 of the marking device 10 powers the solenoid 44 and accelerates the piston 48 rightwardly in the drawings, accelerating the pin 50 until its point impacts the surface of a workpiece (not shown).

To ensure that the surface to be marked by the pin 50 is located appropriately with respect to the pin, a window 64 is provided which is secured to the side of the housing body 14 by bolts 65. The window 64 comprises an essentially tubular body with an elastomeric frame 66 formed at its end. The window frame 66 has a central aperture 70 defining the limits of movement of the pin 50 within an x, y coordinate system.

In FIG. 1, the window 64 has a flat front face 72, but when pipes or the like are to be marked, a V-shaped front face 72' is provided in alternative window 64', as shown in the inset to FIG. 1. The bolts 65 pass through slots 74 (visible only in the inset to FIG. 1) whereby the longitudinal position (in the z direction) of the window 64 with respect to the pin head 50 is adjustable. This ensures that the surface of the article to be marked is correctly distanced from the pin 50.

As mentioned above, the pin 50 is able to traverse an x,y field approximately equal to the extent of the window 70. The head 40 moves in the first, x direction by movement of the carriage 32 along the rail 28. An essentially U-shaped, sheet-metal plate 80 has its arms 80*a,b* bent out of the plane of its base 80*c* into planes orthogonal thereto. The arms 80*a, b* are bolted to the solenoid base 34 by screws 82 both above and below the carriage 32 and rail 28. To the base 80*c* is bolted a first stepper motor 84 by bolts and nuts 86.

The motor 84 rotates within its body a hollow, screw-threaded armature (not shown) which is screw-threaded on a first fixed screw 88. The fixed screw 88 is received between arms 23 of the frame 20, extending from the base 21 thereof. The screw 88 is received in bushings 90 and locked in place by a grub screw 92. Thus, when the motor 84 is actuated, it traverses up and down the screw 88 as its armature screws on the screw 88. This moves the entire carriage 32 and connected marking head 40 backwards and forwards in the x direction.

A sub-frame 94 has pivot pins 96 at each end which are journaled in bearing bushes 98 formed in the ends of the arms 23 of the frame 20. A second motor 100 is bolted to the sub-frame 94 by bolts 102. A second fixed screw 104 is fixed at one end in a clevis 106 by a grub screw 107. The clevis 106 has two pivot pins 108 received in bearing bushes 110 formed in each clam shell half 12*a,b* in the handle region 16 of the device 10. Unlike the bearing bushes 24, no disc springs are required here, partly because the tolerances over the width of the handle 16 are less than over the width of the body 14, but primarily because lateral slackness of the fixing of the levis 106 is not important. It is only important that there should be no slackness of the clevis in the longitudinal direction of the screw 104, that is to say, in the y direction.

Like the motor 84, the motor 104 has a rotary armature having a threaded bore which is screwed onto the fixed screw 104. Consequently, rotation of the motor 100 pivots the frame 20 with respect to the housing 14 about the pivot axis formed by the pivot pins 22 so as to move the marking pin 50 in an arc which approximates the y direction. Consequently, under appropriate control, the marking pin 50 can be positioned over the surface of a cylinder of radius equal to the distance from the pin head to the pivot axis 22. In order to make the surface of the cylinder as flat as possible so that the x,y field is as flat as possible, the axis 22 is near to the point of actuation (the intersection of the screw 104 with the pivot axis 96 of the sub-frame 94). Indeed, it is as close as possible to the sub-frame axis 96 without compromising the resolution in the y direction achievable by the motor 100.

The motors 100, 84 are driven by leads 112, 114 respectively connected to distribution board 67. Distribution board 67 has sockets 116 to receive plugs on the end of a cable (not shown) extending from an aperture 118 formed in the base of the handle 16. Lead 120 is connected to a control console 122 (both the lead 120 and console 122 being shown schematically in FIG. 1). Console 122 controls by any appropriate means the rotation of the motors 100, 84 and the timing of energisation of the solenoid 44 to effect a mark on a surface in plane 62. A trigger 124 on the pistol grip handle 16 actuates the console 122 to commence a marking sequence. A series of marks so effected can define characters, machine readable or otherwise.

From the foregoing description, it is apparent that nearly all the components, at least the massive ones, of the marking device 10 are contained along the axis of the pin 50, being the z axis and directions of impacting of the pin 50. There is therefore the maximum possible inertial mass behind the piston 48 ensuring its acceleration in the z direction is with minimum recoil experienced by the user. On the other hand, rebound of the piston 48 is received directly on the carriage 32, via the cushioning O-ring 58, for maximum energy absorption in the relatively massive rail 28, and subsequently the frame 20 and ultimately the housing 12. Consequently, while firm holding of the device 10 against a surface to be marked is possible with the handles 16,18, the tendency for the device to "walk" during repeated marking operations is reduced by the concentrated inertia in the line of force application which reduces vibration; the large radius of rotation of the movement in the y direction, tending to maintain the substantially orthogonal attitude of the marking head with respect to a flat surface; and the elastomeric facing of the window 64. On the other hand, by combining various components such as the housing/frame, and motor heatsink/subframe into single components, as well as by disposing the motors within the confines of the frame, a light and compact marking device is achieved which still has precise and reliable accuracy.

What is claimed is:

1. A marking device comprising:

a housing encasing the device;

a frame, pivotally connected to the housing about a first axis;

a marking head mounted on the frame;

a first motor to drive the marking head in the frame in a first direction parallel said first axis and spaced therefrom; and a second motor mounted in the housing arranged to pivot the frame with respect to the housing about said first axis in a second, substantially orthogonal direction; wherein, during assembly of the device, the frame and said second motor are not supported with respect to one another until said housing encasing the device is assembled on and connected to the frame and the second motor whereupon the second motor is rendered capable of pivoting the frame in the housing.

2. A marking device as claimed 1, in which the housing further comprises a handle by means of which the device is manipulatable.

3. A marking device as claimed 1, in which a window is provided in the housing through which the marking head protrudes, said window having a face to rest, in use, against an object to be marked to stabilise the device.

4. A marking device as claimed in claim 3, in which the window is detachable from the housing for replacement with differently shaped windows for abutment against differently shaped objects to be marked.

5. A marking device as claimed in claim 3, in which the window comprises a V-section across said first direction and is adjustable on the housing in a third direction substantially orthogonal to said first and second directions.

6. A marking device as claimed in claim 3, in which the window has a facing of resilient material adapted to abut a surface to be marked.

7. A marking device as claimed in claim 1, in which said marking head has a pin arranged to be driven in a third direction substantially orthogonal said first and second directions against a surface to be marked.

8. A marking device as claimed in claim 7, in which said marking head has a head housing and a solenoid in the head housing to drive said pin, said head housing and solenoid defining a chamber in which is slidably disposed a ferromagnetic piston to impact a base of said pin.

9. A marking device as claimed in claim 8, in which a return spring is disposed between the pin and the piston to return the pin and piston to a ready position.

10. A marking device as claimed in claim 1, in which the frame comprises a rail and a carriage slideable along said rail in said first direction.

11. A marking device as claimed in claim 7, in which the frame comprises a rail and a carriage slideable along said rail in said first direction, and in which said head housing is mounted substantially directly on said carriage so that the rail, carriage and head housing all lie in said third direction, said head housing having substantially the same dimensions as said carriage, so that recoil impacts of said piston are transmitted directly into said carriage and thence to the rail and frame.

12. A marking device as claimed in claim 1, in which said housing is a clamshell housing opening in said first direction, each clamshell having a bearing bush and said frame having pivot pins captured in said bearing bushes.

13. A marking device as claimed in claim 12, in which a disc spring is disposed on at least one pin between the housing and the frame to take up any tolerance between the housing and frame.

14. A marking device as claimed in claim 1, further comprising:

a carriage mounted on the frame for translational movement in the frame in a first direction parallel said first axis and spaced therefrom;

said marking head being mounted in the carriage wherein said marking head includes a stylus pin and drive means to drive the pin in a third direction substantially orthogonal said first and second directions against a surface to be marked, said first and second directions defining a plane said third direction lying in a plane parallel said first direction; and the frame, carriage, marking head, and first and second motors being disposed in the housing so that a centre of gravity of the frame, carriage, marking head, and first and second motors is sufficiently coincident said plane over all movements of the frame in said second direction wherein recoils of the marking head when the stylus is driven by said drive means do not cause moments about said centre of gravity.

15. A marking device as claimed in 14, in which the housing further comprises a handle by means of which the device is manipulatable.

16. A marking device as claimed in 14, in which the motors each comprise a body, a rotary armature, and a screw, on which screw the armature is threaded, the screw being fixed.

17. A marking device as claimed in claim 16, in which the first motor is carried on the carriage, the screw of the first motor being fixed in the frame.

18. A marking device as claimed in claim 17, in which the frame comprises a U-shaped element along the base of which is fixed a rail and between the arms of which is fixed the screw.

19. A marking device as claimed in claim 18, in which the marking head, carriage, rail and the rotational axis of said first motor, are all in line in said plane.

20. A marking device as claimed in claim 16, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, the screw of the second motor being fixed in said clevis.

21. A marking device as claimed in claim 19, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, and in which said sub-axis is also inline with said marking head, carriage, rail and the rotational axis of said first motor.

22. A marking device as claimed in claim 20, in which said housing is a clamshell housing opening in said first direction, each clamshell having a bearing bush and said frame having pivot pins captured in said bearing bushes, and in which the housing further comprises a handle by means of which the device is manipulatable, and in which each clamshell has a handle bearing bush in the region of the clamshell forming said handle of the device, said clevis comprising pivot pins captured in said handle bearing bushes.

23. A marking device as claimed in claim 14, wherein said frame is pivotally mounted in the housing about said first axis.

24. A marking device as claimed 14, in which a window is provided in the housing through which the marking head protrudes, said window having a face to rest, in use, against an object to be marked to stabilise the device.

25. A marking device as claimed in claim 14, in which the marking head has a head housing and a solenoid in the head housing to drive said pin, said head housing and solenoid defining a chamber in which is slidably disposed a ferromagnetic piston to impact a base of said pin.

26. A marking device as claimed in claim 14, in which the frame comprises a rail, said carriage being slidable along said rail in said first direction.

27. A marking device as claimed in claim 25, in which the frame comprises a rail, said carriage being slidable along said rail in said first direction, and in which said head housing is mounted substantially directly on said carriage so that the rail, carriage and head housing all lie in said third direction, said head housing having substantially the same dimensions as said carriage, so that recoil impacts of said piston are transmitted directly into said carriage and thence to the rail and frame.

28. A marking device as claimed in claim 23, in which said housing is a clamshell housing opening in said first direction, each clamshell having a bearing bush, and said frame having pivot pins captured in said bearing bushes.

29. A marking device as claimed in claim 28, in which a disc spring is disposed on at least one pin between the housing and the frame to take up any tolerance between the housing and frame.

30. A marking device as claimed in claim 1, further comprising:

a carriage mounted on the frame for translational movement in the frame in a first direction parallel said first axis and spaced therefrom;

said marking head being mounted in the carriage wherein said motors are disposed substantially within the confines of the frame.

31. A marking device as claimed in 30, in which the housing further comprises a handle by means of which the device is manipulatable.

32. A marking device as claimed in 30, in which the motors each comprise a body, a rotary armature, and a screw, on which screw the armature is threaded, said screw being fixed.

33. A marking device as claimed in claim 32, in which the first motor is carried on the carriage, the screw of the first motor being fixed in the frame.

34. A marking device as claimed in claim 32, in which the frame comprises a U-shaped element having a base and arms, a rail being fixed along the base and the screw being fixed between the arms.

35. A marking device as claimed in claim 34, in which the marking head, carriage, rail and the rotational axis of said first motor, are all in line.

36. A marking device as claimed in claim 30, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, the screw of the second motor being fixed in said clevis.

37. A marking device as claimed in claim 34, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, and in which said sub-axis is also inline with said marking head, rail and the rotational axis of said first motor.

38. A marking device as claimed in claim 37, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, and in which said sub-axis is also inline with said marking head, carriage, rail and the rotational axis of said first motor.

39. A marking device as claimed 30, in which a window is provided in the housing through which the marking head protrudes, said window having a face to rest, in use, against an object to be marked to stabilise the device.

40. A marking device as claimed in claim 30, in which said marking head has a pin arranged to be driven in a third direction substantially orthogonal said first and second directions against a surface to be marked.

41. A marking device as claimed in claim 40, in which said marking head has a head housing and a solenoid in the head housing to drive said pin, said head housing and solenoid defining a chamber in which is slidably disposed a ferromagnetic piston to impact a base of said pin.

42. A marking device as claimed in claim 30, in which the frame comprises a rail, said carriage being slidable along said rail in said first direction.

43. A marking device as claimed in claim 41, in which the frame comprises a rail, said carriage being slidable along said rail in said first direction, and in which said head housing is mounted substantially directly on said carriage and is about the same dimensions as said carriage so that recoil impacts of said piston are transmitted directly into said carriage and thence to the rail and frame.

44. A marking device as claimed in claim 30, in which said housing is a clamshell housing opening in said first direction, each clamshell having a bearing bush and said frame having pivot pins captured in said bearing bushes.

45. A marking device as claimed in claim 1, in which said marking head has a marking point, which point is the tip of a marking pin of the marking head and at which the marking head contacts, in use, a surface to be marked, in which said second motor has a point of application at which it effects said pivoting of the frame, and in which said first axis is disposed between, and spaced from, said marking point and said point of application.

46. A marking device as claimed in 45, in which the distance between the marking point and said first axis is greater than the distance between said first axis and said point of application.

47. A marking device as claimed in claim 45, further comprising a sub-frame, which is pivotally mounted in the frame about a sub-axis parallel said first axis, the second motor being fixed in said sub-frame, in which said point of application comprises said sub-axis.

48. A marking device as claimed in claim 2, in which said handle comprises a pistol grip and includes a trigger to actuate the marking device.

49. A marking device as claimed in claim 1, further comprising a separate console controlling actuation of the motors to move the marking head in a desired pattern and to fire the marking head.

50. A marking device as claimed in claims 48, further comprising a separate console controlling actuation of the motors to move the marking head in a desired pattern and to fire the marking head, in which a control lead from said console enters a base of said pistol grip handle.

51. A marking device as claimed in claim 50, in which a distribution board is disposed in said pistol grip handle and said control lead terminates on said distribution board.

52. A marking device as claimed in claim 1, further comprising:

a carriage mounted on the frame for translational movement in the frame in a first direction parallel said first axis and spaced therefrom;

said marking head being mounted in the carriage wherein said marking head includes a stylus pin and drive means to drive the pin in a third direction substantially orthogonal said first and second directions against a surface to be marked, said first and second directions defining a plane said third direction defining a plane parallel said first direction;

the motors each comprise a body, a rotary armature, and a screw, on which screw the armature is threaded;

the first motor is carried on the carriage, the screw of the first motor being fixed in the frame;

the frame comprises a U-shaped element along the base of which element is fixed a rail on which the carriage slides and between the arms of which element is fixed the screw;

the marking head, carriage, rail and the rotational axis of said first motor, are all in line in said plane.

53. A marking device as claimed in claim 52, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, the screw of the second motor being fixed in said clevis.

54. A marking device as claimed in claim 52, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, and in which said sub-axis is also in line with said marking head, carriage, rail and the rotational axis of said first motor.

55. A marking device comprising:

a housing encasing the device;

a frame, pivotally connected to the housing about a first axis;

a marking head mounted on the frame;

a first motor to drive the marking head in the frame in a first direction parallel said first axis and spaced therefrom; and a second motor mounted in the housing arranged to pivot the frame with respect to the housing about said first axis in a second, substantially orthogonal direction; wherein during assembly of the device, the housing mechanically and operatively couples the frame to the second motor whereupon the second motor is rendered capable of pivoting the frame in the housing.

56. A marking device as claimed in claim 55, further comprising:

a carriage mounted on the frame for translational movement in the frame in a first direction parallel said first axis and spaced therefrom;

a marking head mounted in the carriage.

57. A marking device comprising:

a housing of the device;

a frame arranged for pivotal movement with respect to the housing about a first axis;

a carriage mounted on the frame for translational movement in the frame in a first direction parallel said first axis and spaced therefrom;

a marking head being mounted in the carriage;

a first motor to drive the marking head in the frame; and a second motor arranged to pivot the frame with respect to the housing about said axis in a second, substantially orthogonal, direction; wherein said marking head includes a stylus pin and drive means to drive the pin in a third direction substantially orthogonal said first and second directions against a surface to be marked, said first and second directions defining a plane said third direction lying in a plane parallel said first direction;

the frame, carriage, marking head, and first and second motors being disposed in the housing so that a centre of gravity of the frame, carriage, marking head, and first and second motors is sufficiently coincident said plane over all movements of the frame in said second direction wherein recoils of the marking head when the stylus is driven by said drive means do not cause moments about said centre of gravity;

the motors each comprise a body, a rotary armature, and a screw, on which screw the armature is threaded, the screw being fixed; and the first motor is carried on the carriage, the screw of the first motor being fixed in the frame.

58. A marking device as claimed in claim 57, in which the housing further comprises a handle by means of which the device is manipulatable.

59. A marking device as claimed in claim 57, in which the frame comprises a U-shaped element along the base of which is fixed a rail and between the arms of which is fixed the screw.

60. A marking device as claimed in claim 59, in which the marking head, carriage, rail and the rotational axis of said first motor, are all in line in said plane.

61. A marking device as claimed in claim 60, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, and in which said sub-axis is also inline with said marking head, carriage, rail and the rotational axis of said first motor.

62. A marking device comprising:

a housing of the device;

a frame arranged for pivotal movement with respect to the housing about a first axis;

a carriage mounted on the frame for translational movement in the frame in a first direction parallel said first axis and spaced therefrom;

a marking head being mounted in the carriage;

a first motor to drive the marking head in the frame; and a second motor arranged to pivot the frame with respect to the housing about said axis in a second, substantially orthogonal, direction; wherein said marking head includes a stylus pin and drive means to drive the pin in a third direction substantially orthogonal said first and second directions against a surface to be marked, said first and second directions defining a plane said third direction lying in a plane parallel said first direction;

the frame, carriage, marking head, and first and second motors being disposed in the housing so that a centre of gravity of the frame, carriage, marking head, and first and second motors is sufficiently coincident said plane over all movements of the frame in said second direction wherein recoils of the marking head when the stylus is driven by said drive means do not cause moments about said centre of gravity;

the motors each comprise a body, a rotary armature, and a screw, on which screw the armature is threaded, the screw being fixed; and a sub-frame, which is pivotally mounted in the frame about a sub-axis parallel said first axis, the second motor being fixed in said sub-frame, and a clevis, which is pivotally mounted in the housing about a clevis axis also parallel said first axis, the screw of the second motor being fixed in said clevis.

63. A marking device as claimed in claim 62, in which said housing is a clamshell housing opening in said first direction, each clamshell having a bearing bush and said frame having pivot pins captured in said bearing bushes, and in which the housing further comprises a handle by means of which the device is manipulatable, and in which each clamshell has a handle bearing bush in the region of the clamshell forming said handle of the device, said clevis comprising pivot pins captured in said handle bearing bushes.

64. A marking device comprising:

a housing of the device;

a frame arranged for pivotal movement with respect to the housing about a first axis;

a carriage mounted on the frame for translational movement in the frame in a first direction parallel said first axis and spaced therefrom;

a marking head being mounted in the carriage a first motor to drive the marking head in the frame; and a second motor arranged to pivot the frame with respect to the housing about said axis in a second, substantially orthogonal, direction; wherein said motors are disposed substantially within the confines of the frame;

the motors each comprise a body, a rotary armature, and a screw, on which screw the armature is threaded, said screw being fixed; and the first motor is carried on the carriage, the screw of the first motor being fixed in the frame.

65. A marking device as claimed in 64, in which the housing further omprises a handle by means of which the device is manipulatable.

66. a marking device as claims in 64, in which the housing further comprises a handle by means of which the device may be manipulated.

67. A marking device as claimed in claim 64, in which the frame comprises a U-shaped element having a base and arms, a rail being fixed along the base and the screw being fixed between the arms.

68. A marking device as claimed in claim 67, in which the marking head, carriage, rail and the rotational axis of said first motor, are all in line.

69. A marking device as claimed 64, in which a window is provided in the housing through which the marking head protrudes, said window having a face to rest, in use, against an object to be marked to stabilise the device.

70. A marking device as claimed in claim 64, in which said marking head has a pin arranged to be driven in a third direction substantially orthogonal said first and second directions against a surface to be marked.

71. A marking device as claimed in claim 70, in which said marking head has a head housing and a solenoid in the head housing to drive said pin, said head housing and solenoid defining a chamber in which is slidably disposed a ferromagnetic piston to impact a base of said pin.

72. A marking device as claimed in claim 71, in which the frame comprises a rail, said carriage being slidable along said rail in said first direction, and in which said head housing is mounted substantially directly on said carriage and is about the same dimensions as said carriage so that recoil impacts of said piston are transmitted directly into said carriage and thence to the rail and frame.

73. A marking device as claimed in claim 64, in which the frame comprises a rail, said carriage being slidable along said rail in said first direction.

74. A marking device as claimed in claim 64, in which said housing is a clamshell housing opening in said first direction, each clamshell having a bearing bush and said frame having pivot pins captured in said bearing bushes.

75. A marking device as claimed in claim 67, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, and in which said sub-axis is also inline with said marking head, rail and the rotational axis of said first motor.

76. A marking device as claimed in claim 75, further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, and in which said sub-axis is also inline with said marking head, carriage, rail and the rotational axis of said first motor.

77. A marking device comprising:

a housing of the device;

a frame arranged for pivotal movement with respect to the housing about a first axis;

a carriage mounted on the frame for translational movement in the frame in a first direction parallel said first axis and spaced therefrom;

a marking head being mounted in the carriage a first motor to drive the marking head in the frame; and a second motor arranged to pivot the frame with respect to the housing about said axis in a second, substantially orthogonal, direction; wherein said motors are disposed substantially within the confines of the frame;

said marking device further comprising a sub-frame, which is pivotally mounted in the frame about a sub-axis parallel said first axis, the second motor being fixed in said sub-frame, and a clevis, which is pivotally mounted in the housing about a clevis axis also parallel said first axis, the screw of the second motor being fixed in said clevis.

* * * * *